US010292877B2

(12) United States Patent
Trepanier et al.

(10) Patent No.: US 10,292,877 B2
(45) Date of Patent: May 21, 2019

(54) PATIENT TRANSPORT APPARATUS FOR TRANSPORTING A PATIENT OVER DISTURBANCES IN FLOOR SURFACES

(71) Applicant: Stryker Corporation, Kalamazoo, MI (US)

(72) Inventors: Jerald A. Trepanier, Kalamazoo, MI (US); Kevin M. Patmore, Plainwell, MI (US); Anish Paul, Portage, MI (US); William D. Childs, Plainwell, MI (US); Kurosh Nahavandi, Portage, MI (US); Clifford E. Lambarth, Portage, MI (US)

(73) Assignee: STRYKER CORPORATION, Kalamazoo, MI (US)

( * ) Notice: Subject to any disclaimer, the term of this patent is extended or adjusted under 35 U.S.C. 154(b) by 210 days.

(21) Appl. No.: 15/257,060

(22) Filed: Sep. 6, 2016

(65) Prior Publication Data

US 2017/0065474 A1 Mar. 9, 2017

Related U.S. Application Data

(60) Provisional application No. 62/216,091, filed on Sep. 9, 2015.

(51) Int. Cl.
*A61G 1/02* (2006.01)
*A61G 7/018* (2006.01)
(Continued)

(52) U.S. Cl.
CPC ..... *A61G 1/02* (2013.01); *A61G 1/0287* (2013.01); *A61G 1/042* (2016.11); *A61G 7/018* (2013.01);
(Continued)

(58) Field of Classification Search
CPC ..... A61G 1/02; A61G 1/042; A61G 1/0287; A61G 7/018; A61G 1/0212; A61G 1/0237; A61G 7/08
See application file for complete search history.

(56) References Cited

U.S. PATENT DOCUMENTS 4,095,822 A 6/1978 Thornhill
4,541,134 A 9/1985 Black et al.
(Continued)

FOREIGN PATENT DOCUMENTS

CN 101627943 A 1/2010
GB 2289113 A 8/1995
(Continued)

OTHER PUBLICATIONS

English language abstract and machine-assisted English translation for CN 101627943 extracted from espacenet.com database on May 3, 2018, 8 pages.
(Continued)

*Primary Examiner* — Faye M Fleming
(74) *Attorney, Agent, or Firm* — Howard & Howard Attorneys PLLC

(57) ABSTRACT

A patient transport apparatus for moving a patient from one location to another. The patient transport apparatus comprises a suspension system to limit discomfort to the patient when the patient transport apparatus moves over disturbances in floor surfaces. The suspension system comprises suspension devices such as a spring and/or a damper. The suspension system is operable in an energy-absorbing mode in which the suspension system absorbs energy as wheels move over the disturbances during transport or a lockout mode in which the suspension system is relatively more
(Continued)

rigid as compared to the energy-absorbing mode. A control system operates to place the suspension system in one of the modes.

22 Claims, 6 Drawing Sheets

(51) Int. Cl.
*A61G 1/04* (2006.01)
*A61G 7/08* (2006.01)

(52) U.S. Cl.
CPC ..... *A61G 1/0212* (2013.01); *A61G 1/0237* (2013.01); *A61G 7/08* (2013.01); *A61G 2203/30* (2013.01)

(56) References Cited

U.S. PATENT DOCUMENTS

| | | | | |
|---|---|---|---|---|
| 6,241,059 | B1 | 6/2001 | Fujita et al. | |
| 6,729,667 | B2 | 5/2004 | Henderson et al. | |
| 6,752,224 | B2 | 6/2004 | Hopper et al. | |
| 6,772,850 | B1 | 8/2004 | Waters et al. | |
| 6,792,630 | B1 | 9/2004 | Palmatier et al. | |
| 7,007,765 | B2 | 3/2006 | Waters et al. | |
| 8,109,525 | B2 * | 2/2012 | Salus | A61G 7/08 180/209 |
| 8,746,710 | B2 * | 6/2014 | Schejbal | A61G 7/018 280/43 |
| 9,259,369 | B2 | 2/2016 | Derenne et al. | |
| 9,320,444 | B2 | 4/2016 | Hayes et al. | |
| 2003/0159861 | A1 | 8/2003 | Hopper et al. | |
| 2006/0045647 | A1 | 3/2006 | Verbrugge et al. | |
| 2006/0213009 | A1 | 9/2006 | Stevens | |
| 2006/0236456 | A1 | 10/2006 | Beale | |
| 2007/0089236 | A1 | 4/2007 | Bailey-VanKuren et al. | |
| 2007/0113344 | A1 * | 5/2007 | Hurwitz | A61G 7/05 5/620 |
| 2007/0245488 | A1 * | 10/2007 | Zimbalista | A61G 7/0507 5/86.1 |
| 2010/0006362 | A1 | 1/2010 | Armstrong | |
| 2015/0014959 | A1 | 1/2015 | Youngmann et al. | |
| 2017/0172821 | A1 * | 6/2017 | Childs | A61G 1/0268 |

FOREIGN PATENT DOCUMENTS

| | | | |
|---|---|---|---|
| JP | H08140780 | A | 6/1996 |
| WO | WO 2005051278 | A1 | 6/2005 |

OTHER PUBLICATIONS

English language abstract and machine-assisted English translation for JPH 08-140780 extracted from espacenet.com database on May 3, 2018, 18 pages.
English language abstract and machine-assisted translation for WO 2005051278 extracted from espacenet.com Nov. 29, 2016, 4 pages.

* cited by examiner

PATIENT TRANSPORT APPARATUS FOR TRANSPORTING A PATIENT OVER DISTURBANCES IN FLOOR SURFACES

CROSS-REFERENCE TO RELATED APPLICATION

This application claims priority to and the benefit of U.S. Provisional Patent Application No. 62/216,091, filed on Sep. 9, 2015, the disclosure of which is hereby incorporated by reference in its entirety.

BACKGROUND

Patient transport apparatuses such as hospital beds, stretchers, cots, and wheelchairs are routinely used by caregivers to move patients from one location to another. Conventional patient transport apparatuses include a support structure comprising a patient support surface upon which the patient is supported during movement. Wheels are coupled to the support structure to ease transport over floor surfaces. A handle or other form of interface facilitates movement of the patient transport apparatus by the caregiver.

As the caregiver moves the patient transport apparatus, disturbances in the floor surfaces are often encountered. These disturbances can be caused by bumps, depressions, thresholds between adjacent floor surfaces, and the like. When one or more of the wheels engage such disturbances, forces are directed vertically toward the patient support surface. As a result, the patient may experience discomfort.

DETAILED DESCRIPTION

Figure 1:
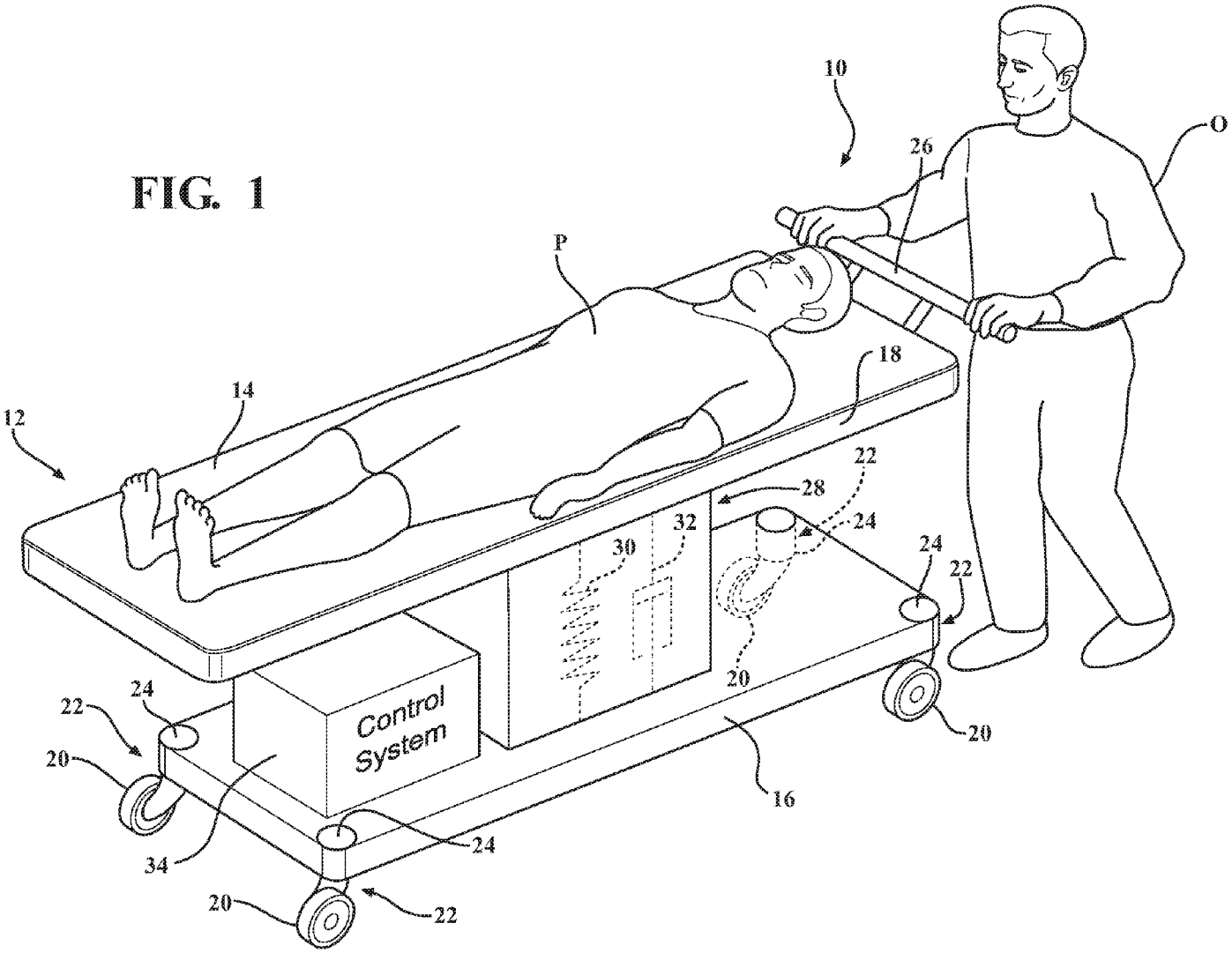
FIG. 1 is a perspective and partially schematic view of a patient transport apparatus.

Referring to FIG. 1, a patient transport apparatus 10 is shown for moving a patient P from one location to another. The patient transport apparatus 10 illustrated in FIG. 1 is a stretcher. In other embodiments, however, the patient transport apparatus 10 may be a hospital bed, cot, wheelchair, or similar apparatus.

A support structure 12 provides support for the patient P during transport with the patient transport apparatus 10. The support structure 12 illustrated in FIG. 1 comprises a base frame 16 and an intermediate frame 18. The intermediate frame 18 is spaced above the base frame 16. The intermediate frame 18 comprises a patient support surface 14 upon which the patient P is supported during movement. Numerous configurations of the support structure 12 are contemplated. For instance, the support structure 12 may comprise the base frame 16, intermediate frame 18, and a patient support deck (not shown) disposed on the intermediate frame 18. In that case, the patient support deck comprises the patient support surface 14. The patient support deck may comprise sections to support the patient P, some of which are pivotable relative to the intermediate frame 18, such as a head section, a seat section, a thigh section, and a foot section. The construction of base frame 16, intermediate frame 18, or patient support deck may take on any known or conventional design.

Wheels 20 are coupled to the support structure 12 to facilitate transport over floor surfaces. FIG. 1 illustrates four wheels 20 coupled to the support structure 12. The wheels 20 rotate and swivel relative to the support structure 12 during transport. In the embodiment shown, each of the wheels 20 forms part of a caster 22. Hubs 24 support the casters 22. The hubs 24 are fixed to the base frame 16. It should be understood that various configurations of the wheels 20 are contemplated and that each of the four wheels 20 may be non-steerable, steerable, powered, or combinations thereof. Additional wheels are also contemplated. For example, the patient transport apparatus 10 may comprise four non-powered, non-steerable wheels, along with one or more powered wheels. In other embodiments, one or more auxiliary wheels (powered or non-powered), which are movable between stowed positions and deployed positions, may be coupled to the support structure 12. In some cases, when these auxiliary wheels are located between casters and contact the floor surface in the deployed position, they cause two of the casters to be lifted off the floor surface thereby shortening a wheel base of the patient transport apparatus 10.

An operator interface 26 enables an operator O to move the patient transport apparatus 10 between locations. In the embodiment shown in FIG. 1, the operator interface 26 is a handle coupled to the support structure 12, and the operator interface 26 is rigidly fixed to the intermediate frame 18. The operator interface 26 is graspable by the operator O to manipulate the patient transport apparatus 10 for transport. Other forms of the operator interface 26 are also contemplated. For instance, the operator interface may simply be a surface on the patient transport apparatus 10 upon which the operator O logically applies force to cause movement of the patient transport apparatus 10 in one or more directions. This may comprise one or more surfaces on the intermediate frame 18 or base frame 16. This could also comprise one or more surfaces on a headboard, footboard, and/or side rail when the patient transport apparatus 10 comprises such components. In other embodiments, the operator interface may comprise separate handles for each hand of the operator O. For example, the operator interface may comprise one or more handles for controlling operation of a powered wheel (not shown) for powered movement of the patient transport apparatus 10.

A suspension system 28 is provided to limit discomfort to the patient P or instability when the patient transport apparatus 10 moves over disturbances in the floor surfaces. These disturbances can be caused by bumps, depressions, thresholds between adjacent floor surfaces, and the like. When one or more of the wheels 20 engage a disturbance in a floor surface, forces are directed vertically toward the patient support surface 14. The suspension system 28 ensures that these forces are not fully transmitted to the patient support surface 14 by absorbing and dissipating energy associated with these forces.

The suspension system 28 comprises suspension devices such as a spring 30 and/or a damper 32 to absorb and dissipate energy, respectively. The spring 30 and damper 32 are illustrated schematically in FIG. 1 as being disposed between the intermediate frame 18 and the base frame 16. It should be appreciated that the suspension system 28 may utilize one or more suspension devices. The suspension devices may comprise mono-tube shock absorbers, twin-tube shock absorbers, passive vibration absorbers, electronic actuators, rubber dampeners, magnetic dampeners, coil springs, leaf springs, torsion bars, progressive rate springs, pneumatic springs, or the like, which are each suitable to absorb and/or dissipate energy.

The suspension devices may be adjustable to adjust the energy absorption and/or damping characteristics of the suspension devices. For instance, in the embodiment shown, the spring 30 has an adjustable spring parameter, such as an adjustable spring rate (k). The spring rate (k) represents the energy absorption capability of the spring 30. The damper 32 is adjustable so that the damper 32 has an adjustable damping effect. The damper 32 may be an adjustable shock absorber. In other embodiments, variable viscosity fluids may be utilized to modify the damping effect, such as magnetorheological fluids.

The suspension system 28 operates in at least a first mode or a second mode. The first mode is an energy-absorbing mode in which the suspension system 28 absorbs energy as the wheels 20 move over the disturbances in the floor surfaces during transport to limit energy transfer to the patient support surface 14 thereby limiting discomfort to the patient P. The second mode is a lockout mode in which the suspension system 28 is relatively more rigid as compared to the energy-absorbing mode. In other words, the suspension system 28 has a first stiffness in the energy-absorbing mode and a second stiffness greater than the first stiffness in the lockout mode.

In some embodiments, in the lockout mode, the suspension system 28 is bypassed altogether so that the suspension system 28 is incapable of absorbing and dissipating energy. This can be accomplished in a variety of ways, including by one or more switches, or inclusion of a mechanical bypass such that the suspension system 28 is not engaged in the lockout mode. In other embodiments, the suspension system 28 is adjusted only slightly to lessen the ability to absorb and dissipate energy in the lockout mode, relative to the energy-absorbing mode. For example, in the embodiment shown, the spring 30 may be fifty percent more rigid in the lockout mode relative to the energy-absorbing mode.

It should be appreciated that the suspension system 28 in the lockout mode may still be capable of absorbing and dissipating some amount of energy. In certain embodiments, the lockout mode should be construed to mean a mode that is more rigid than the energy-absorbing mode, and that there is no specific requirement of the difference in rigidity between the energy-absorbing mode and the lockout mode.

Figure 2:
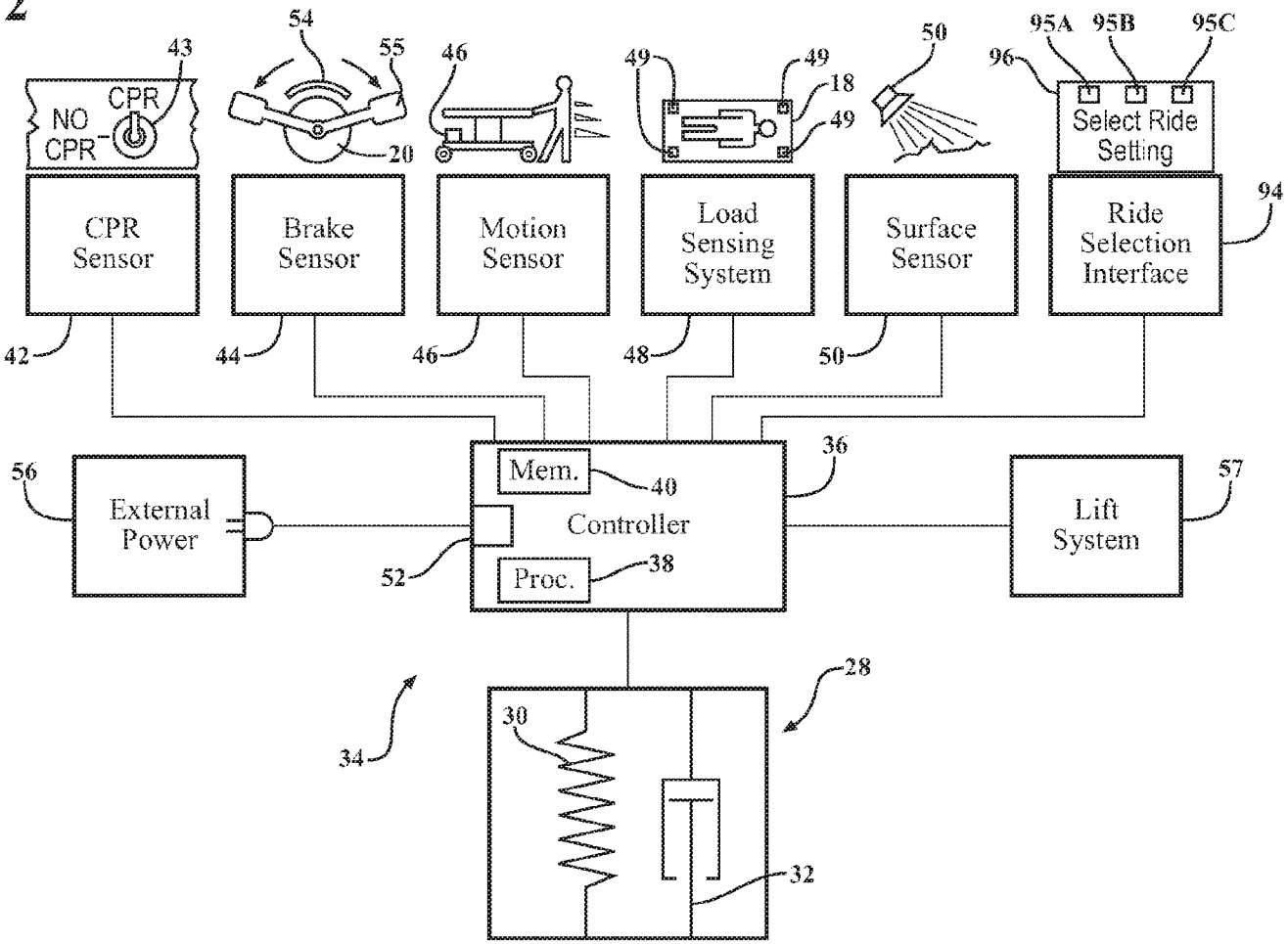
FIG. 2 is a schematic view of a control system of the patient transport apparatus.

Referring to FIG. 2, a control system 34 operates to place the suspension system 28 in one of the energy-absorbing mode or the lockout mode. The control system 34 comprises a controller 36 having one or more microprocessors 38 for processing instructions or an algorithm stored in memory 40 to switch between the modes. Additionally or alternatively, the controller 36 may comprise one or more microcontrollers, field programmable gate arrays, systems on a chip, discrete circuitry, and/or other suitable hardware, software, or firmware that is capable of carrying out the functions described herein.

One exemplary way in which the controller 36 switches between the modes is by adjusting and/or tuning the spring parameter and/or the damping effect to change suspension characteristics of the suspension system 28. For instance, when the spring 30 is a pneumatic spring, the controller 36 transmits a control signal to the suspension system 28 to inflate or deflate the pneumatic spring to change the spring rate (k). In the energy-absorbing mode, the spring rate (k) is set lower as compared to the lockout mode in which the spring rate (k) is set higher, such as to a level in which the suspension system 28 is relatively stiff. The damper 32 can also be adjusted, or kept constant. For instance, in orifice damping, a cross-sectional area of an orifice can be changed to change the damping effect (described further below). In one embodiment, the memory 40 stores spring and damper settings and the controller 36 generates output signals to the suspension system 28 to adjust the spring parameter (e.g., spring rate (k)) and/or the damping effect (e.g., orifice area) based on the spring and damper settings. It should be appreciated that the controller 36 may also adjust and/or tune one or more additional properties of the suspension system 28, such as travel of the one or more suspension devices.

The controller 36 manages operation of the suspension system 28 based upon one or more signals received from one or more status inputs or user inputs (exemplary inputs are described below) of the control system 34. More specifically, the controller 36 receives electrical signals from the one or more status inputs or user inputs, analyzes those signals, and outputs one or more commands to the suspension system 28 that cause the suspension system 28 to operate in a desired one of the energy-absorbing mode or the lockout mode.

In the embodiment shown, the status inputs comprise a CPR sensor 42, a brake sensor 44, a motion sensor 46, a load sensing system 48, a surface sensor 50, and a power detector 52. The status inputs may be operational inputs or patient inputs. Operational inputs are used to determine operational states of the patient transport apparatus 10. Patient inputs are used to determine patient states. The controller 36 is programmed to place the suspension system 28 in the energy-absorbing mode or the lockout mode based on at least one operational state and/or patient state. In some embodiments, the controller 36 automatically switches the suspension system 28 from the energy-absorbing mode to the lockout mode, or vice versa, based on the patient transport apparatus 10 reaching a predefined operational state and/or the patient P reaching a predefined patient state. In some embodiments, the properties of the suspension system 28, such as spring and damper settings, stored in the memory 40 correspond to different operational states and/or patient states.

The CPR sensor 42 (see illustration in FIG. 2) may be operable to detect or be activated to indicate a CPR mode of the patient transport apparatus 10. The CPR sensor 42 is mounted to the intermediate frame 18 or other suitable location. The CPR sensor 42 is considered a patient input used to detect the CPR mode, i.e., if the patient P requires CPR or not. The CPR sensor 42 may be coupled to a CPR selector 43 that is moved by the operator O (or other caregiver) between selections identified by indicia "CPR" and "NO CPR" on the intermediate frame 18 to engage the CPR sensor 42. The CPR selector 43 is moved to the desired selection by the operator O when it is necessary to administer CPR to the patient P. Otherwise, the CPR selector 43 is kept at "NO CPR." The CPR sensor 42 may optionally be coupled to a manual CPR release handle (not shown) such that the CPR sensor 42 is engaged upon actuation of the CPR release handle.

The CPR sensor 42 may be a switch in communication with the controller 36. The CPR sensor 42 causes different input signals to be received by the controller 36 based on the CPR selector 43 being directed at either "CPR" or "NO CPR." If the CPR selector 43 is directed at "CPR," the CPR sensor 42 is triggered, then the controller 36 places the suspension system 28 in the lockout mode. If the CPR selector 43 is directed at "NO CPR," then the controller 36 places the suspension system 28 in the energy-absorbing mode. As a result of this configuration, the patient transport apparatus 10 is more rigid for purposes of administering CPR to the patient P. This improves the effectiveness of the CPR on the patient P. Otherwise, if the suspension system 28 were kept in the energy-absorbing mode, compression forces being applied to the patient P may be undesirably absorbed by the suspension system 28, instead of the patient P, making the CPR less effective.

Detection of the CPR mode could also be possible using the load sensing system 48 described further below, using an accelerometer, using a pressure sensor in a hydraulic lifting system, or using a linear motion sensor. Any of these detection devices could be configured to recognize a chest compression impulse and automatically switch the suspension system 28 to the lockout mode. The energy-absorbing mode could be reactivated manually via a switch on the patient transport apparatus 10 or could be automatic after a time period in which chest compression impulses are no longer detected.

In certain configurations, a brake 54 is operatively coupled to at least one of the wheels 20 to selectively lock and unlock the at least one of the wheels 20 so that, when unlocked, the patient transport apparatus 10 may be transported to different locations (see illustration in FIG. 2). In the embodiment shown, the brake 54 is actuated by a brake pedal 55. The brake pedal 55 is manipulated by the operator O to move the brake 54 between braked and unbraked positions. The brake sensor 44 is in communication with the controller 36 to determine whether the brake 54 is in the braked position or the unbraked position. In this case, the brake sensor 44 may be considered an operational input used to determine whether the brake 54 is in the braked position or the unbraked position.

The brake sensor 44 may be a switch arranged relative to the brake pedal 55 to close when the brake pedal 55 is moved by the operator O to place the brake 54 in the unbraked position and to open when the brake pedal 55 is moved by the operator O to place the brake 54 in the braked position. Other configurations of the brake sensor 44 are also contemplated. It should be appreciated that a variety of brakes may be used in conjunction with the patient transport apparatus 10 described herein, including manual, electric, or magnetic braking systems. In the case of electric braking systems, the brake sensor 44 may be integrated into, or at least responsive to, a user interface in which the operator O electronically manipulates the brake 54 between braked and unbraked positions.

The controller 36 places the suspension system 28 in the lockout mode when the brake 54 is sensed or determined to be in the braked position. The brake 54 could have been applied for many reasons, e.g., the patient transport apparatus 10 has reached its final destination, the patient P may need to ingress or egress the patient transport apparatus 10, or the operator O may need to administer CPR on the patient P. In the braked position, the patient transport apparatus 10 is stationary and there is less need for the suspension system 28 to absorb energy. Furthermore, there are several reasons to keep the suspension system 28 in the lockout mode when the patient transport apparatus 10 is stationary. For instance, in the lockout mode, patient ingress and egress is made easier and CPR is more effective as previously described.

The controller 36 places the suspension system 28 in the energy-absorbing mode when the brake sensor 44 determines that the brake 54 is moved to the unbraked position. The primary reason for the operator O to release the brake 54 is to prepare the patient transport apparatus 10 for movement. For example, when the brake 54 is transitioned from the braked position to the unbraked position, the controller 36 responds by automatically switching the suspension system 28 from the lockout mode to the energy-absorbing mode. As a result, the patient transport apparatus 10 is prepared to absorb energy that might otherwise be transferred to the patient support surface 14 as the patient transport apparatus 10 is moved by the operator O.

The motion sensor 46 is in communication with the controller 36 to determine whether the patient transport apparatus 10 is in motion, e.g., being moved by the operator O, or is stationary. The motion sensor 46 is considered an operational input used to determine whether the patient transport apparatus 10 is moving or stationary. The controller 36 places the suspension system 28 in the lockout mode when the motion sensor 46 determines that the patient transport apparatus 10 is stationary. As mentioned above, there are several reasons to keep the suspension system 28 in the lockout mode when the patient transport apparatus 10 is stationary. The controller 36 places the suspension system 28 in the energy-absorbing mode when the motion sensor 46 determines that the patient transport apparatus 10 is in motion.

The motion sensor 46 may be disposed at various locations relative to the patient transport apparatus 10, such as coupled to the one or more wheels 20, coupled to the base frame 16, coupled to the intermediate frame 18, and/or coupled to the patient support surface 14. It should be also be appreciated that more than one motion sensor 46 may be used to optimally detect motion of the patient transport apparatus 10.

The motion sensor 46 comprises one or more of a speed sensor, a position encoder, an accelerometer, an ultrasound sensor, an electromagnetic motion sensor, or the like that senses motion of the patient transport apparatus 10 and transmits a corresponding signal to the controller 36 so that the controller 36 can determine whether the patient transport apparatus 10 is in motion.

The controller 36 may also be able to determine a velocity and/or acceleration of the patient transport apparatus 10 based on input of the motion sensor 46 and control the suspension system 28 accordingly. For instance, a lookup table of spring rate (k) settings based on velocity may be stored in memory 40 and the controller 36 may instruct the suspension system 28 to adjust the properties of the suspension system 28, such as the spring rate (k) of the spring 30, according to the lookup table of spring rate (k) settings. In addition, the controller 36 may place the suspension system 28 in the energy-absorbing mode if the motion sensor 46 detects a velocity or acceleration that exceeds a predetermined threshold.

The load sensing system 48 is in communication with the controller 36. In one embodiment, the load sensing system 48 transmit signals to the controller 36 so that the controller 36 is able to determine a weight of the patient P, a location of a center of mass of the patient P, and/or general movement of the patient, e.g., is the patient P changing position for ingress or egress relative to the patient support surface 14. Accordingly, the load sensing system 48 is considered a patient input used to sense particular patient states.

In one embodiment, the load sensing system 48 comprises an array of load cells 49, with one of the load cells 49 placed at each corner of the intermediate frame 18 to react to loads on the patient support surface 14. With this placement, the controller 36 is able to determine the weight of the patient P, the location of a center of mass of the patient P on the patient support surface 14, and/or the general movement of the patient P by monitoring changes in the signals from the load cells 49 over time. Alternatively, at least one load cell 49 may be placed under each quarter of the patient support surface 14. It should be appreciated that the various sensors utilized by the load sensing system 48 can be located at any suitable location to detect loads at different locations on the patient support surface 14 of the patient transport apparatus 10.

It should be appreciated the load sensing system 48 may alternatively comprise strain gauges, potentiometers, capacitive sensors, piezo resistive or piezo electric sensors, or any other type of sensors that are capable of detecting loads.

In one embodiment, the controller 36 places the suspension system 28 in the lockout mode when the load sensing system 48 senses that the patient P is positioned for ingress or egress relative to the patient support surface 14, or that the patient P is preparing for ingress or egress relative to the patient support surface 14. By placing the suspension system 28 in the lockout mode, the patient transport apparatus 10 is set to be more rigid so that the patient P can more easily move across the patient support surface 14 for ingress or egress. Otherwise, ingress or egress of the patient P may be difficult if the suspension system 28 is set in the energy-absorbing mode, because the suspension parameters may be too soft.

In another embodiment, the load sensing system 48 is configured to sense that the operator O is pushing on the operator interface 26 of the patient transport apparatus 10 and to place the suspension system 28 in the energy-absorbing mode as a result. By placing the suspension system 28 in the energy-absorbing mode, the patient transport apparatus 10 is set to be less rigid so that the patient transport apparatus 10 can more easily move across the floor surfaces and minimize discomfort to the patient P. The load sensing system 48, in this embodiment, can comprise one or more load cells 49 positioned adjacent to the operator interface 26 such that force sensing can detect a direction and magnitude of exerted forces on the operator interface 26. The controller 36 may be configured to place the suspension system 28 in the energy-absorbing mode after a predetermined amount of time after the operator O exerts a force on the operator interface 26. The controller 36 may optionally be configured to place the suspension system 28 in the energy-absorbing mode only if the force exceeds a predetermined threshold.

The surface sensor 50 is in communication with the controller 36. The surface sensor 50 generates a signal corresponding to the nature of the floor surfaces such that the controller 36 is able to detect the disturbances in the floor surfaces (see illustration in FIG. 2). Thus, the surface sensor 50 is an operational input used to determine if the patient transport apparatus 10 is approaching a disturbance in a floor surface. The controller 36 receives and processes the signal, and transmits a control signal to the suspension system 28 to switch the suspension system 28 from the lockout mode to the energy-absorbing mode upon detecting a floor disturbance.

The surface sensor 50 may be an ultrasound sensor, an electromagnetic sensor, or similar sensor that is suitable to determine the disturbances in the floor surfaces. The surface sensor 50 may be fixed to an outer surface of the base frame 16 or intermediate frame 18. Alternatively, multiple surface sensors 50 may be located on the patient transport apparatus 10. In some embodiments, one surface sensor 50 is arranged to evaluate the floor surface in front of each of the wheels 20. It should be appreciated that the location of the surface sensor 50 is not particularly limited, and can be located at any suitable location so that the surface sensor 50 can detect the disturbances.

The surface sensor 50 may be configured to simply detect if the floor surface is flat or uneven and transmit a signal corresponding to either of these two conditions. In other embodiments, the surface sensor 50 may be able to detect more detail about the disturbances in the floor surfaces. For instance, the surface sensor 50 may be able to detect a height of a bump or threshold about to be reached by the patient transport apparatus 10. In this case, the controller 36 adjusts or modifies the suspension system 28 based on the height of the bump or threshold. For example, the controller 36 may select a spring rate (k) from a lookup table that corresponds to the height of the bump or threshold. The spring rates (k) in the lookup table may decrease as the detected height of the bump increases to lessen the impact to the patient P. Similarly, the damping effect may be increased or decreased based on the detected height and/or spring rate (k) selected.

The power detector 52 is an operational input used to determine if the patient transport apparatus 10 is connected to (e.g., plugged into) an external power source 56 and/or receiving AC power (see illustration in FIG. 2). The controller 36 is configured to place the suspension system 28 in the lockout mode when the patient transport apparatus 10 is detected by the power detector 52 to be connected to the external power source 56. Connection to the external power source 56 is an indication that the patient transport apparatus 10 is likely to be stationary for a prolonged period of time. As a result, there are several reasons to place the suspension system 28 in the lockout mode. In addition, the controller 36 may place the suspension system 28 in the energy-absorbing mode when the patient transport apparatus 10 is detected by the power detector 52 to be disconnected from the external power source 56. Disconnection from the external power source 56 is an indication that the patient transport apparatus 10 is being readied for movement by the operator O and should be placed in the energy-absorbing mode. Various configurations of the power detector 52 are contemplated, including a power detection circuit.

The transition between the modes may occur immediately following the controller 36 determining that an operational state and/or patient state has changed, e.g., immediately following changes in position of the brake 54, immediately after sensing motion of the patient transport apparatus 10, immediately after sensing connection to the external power source 56, etc. Alternatively, the transition between the modes may occur after a predetermined time period has elapsed after the change in the operational state and/or the patient state. The predetermined time period may be at least one second, at least five seconds, at least ten seconds, at least thirty seconds, or at least one minute.

The controller 36 may react independently to each change in operational state and/or patient state or may react to joint changes in operational states and/or patient states. For instance, the controller 36 may switch the suspension system 28 to the lockout mode upon detecting that the brake 54 is in the braked position alone, or in combination with detecting that the brake 54 is in the braked position and detecting that the patient transport apparatus 10 is connected to the external power source 56. As another example, the controller 36 may react to a combination of signals from the surface sensor 50 and the motion sensor 46. The signal from the surface sensor 50 may indicate a height of a bump about to be contacted by one of the wheels 20 and the signal from the motion sensor 46 may indicate a current velocity of the patient transport apparatus 10. The controller 36 may then access a lookup table in memory 40 of spring and/or damper settings based on the height of the bump and current velocity of the patient transport apparatus 10 or an algorithm may be processed that varies spring rate (k) and/or damping effects based on the height of the bump and current velocity of the patient transport apparatus 10 so that the controller 36 may instruct the suspension system 28 to adjust the spring 30 and/or damper 32 accordingly.

One or more of the changes in operational states and/or patient states may be assigned different priorities in the controller 36 such that one change in an operational state or a patient state may be ignored upon detecting a different change in another operational state or patient state. For instance, the CPR mode may be given the highest priority. Normally, if the brake 54 is in the unbraked position, the controller 36 keeps the suspension system 28 in the energy-absorbing mode. However, if the CPR mode is assigned the highest priority and the CPR sensor 42 detects that the patient transport apparatus 10 is being configured for CPR, then the controller 36 places the suspension system 28 in the lockout mode, even though the brake 54 has not moved to the braked position. Thus, the controller 36 ignores all other operational states and/or patient states. The different priorities may be established during manufacture or can be user-settable.

Figure 3:
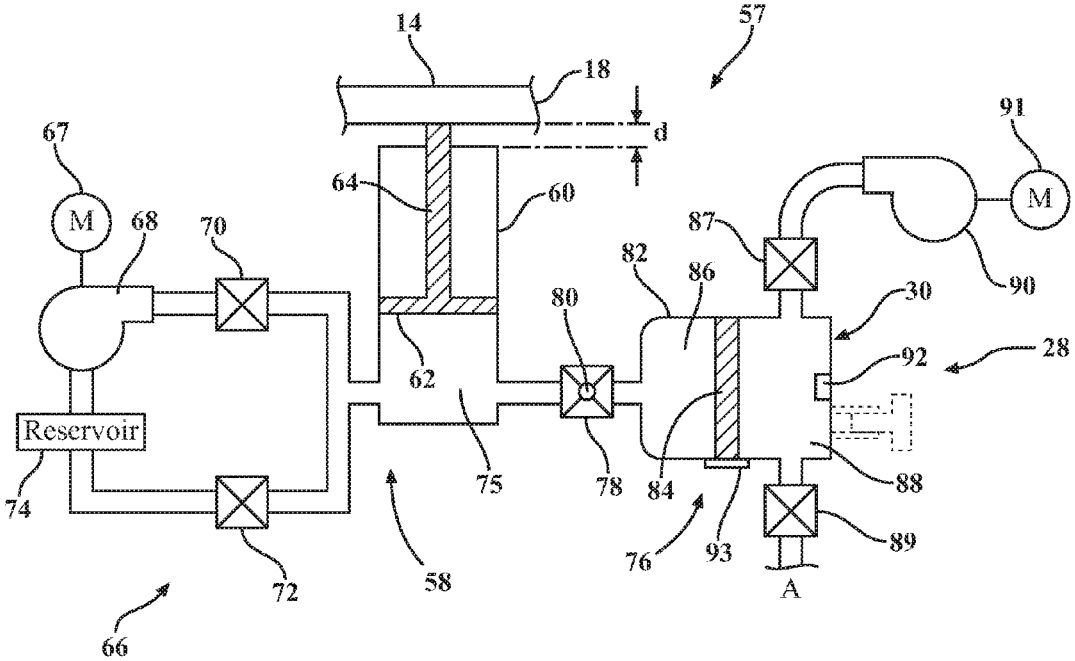
FIG. 3 is an illustration of one embodiment of a suspension system for the patient transport apparatus.

Referring to FIG. 3, in one embodiment, the patient transport apparatus 10 comprises a lift system 57. The lift system 57 is coupled to the patient support surface 14 to raise and lower the patient support surface 14 with respect to the wheels 20. The lift system 57 comprises a hydraulic unit 58. The hydraulic unit 58 comprises a cylinder 60 and a piston 62 slidably disposed in the cylinder 60. A shaft 64 is fixed at one end to the piston 62 and at an opposite end to the intermediate frame 18. As the piston 62 is raised and lowered in the cylinder 60, the shaft 64 raises and lowers the intermediate frame 18 relative to the base frame 16.

A hydraulic fluid circuit 66 manages fluid pressure in the hydraulic unit 58. A lift pump 68 is located in the hydraulic fluid circuit 66 to supply fluid into a lift chamber 75 beneath the piston 62. A motor 67 runs the lift pump 68. A pair of valves 70, 72 are located to control pressure in the hydraulic fluid circuit 66. The motor 67 and valves 70, 72 are in communication with the controller 36. The controller 36 operates the motor 67 and valves 70, 72 to control raising and lowering of the intermediate frame 18 relative to the base frame 16. The controller 36 receives input signals from a user interface (not shown) to determine whether the intermediate frame 18 is to be raised or lowered.

When the user interface indicates that the intermediate frame 18 is to be raised, the controller 36 opens the valve 70, keeps the valve 72 closed, and signals the motor 67 to run the lift pump 68 to pull hydraulic fluid from a reservoir 74 and pump the hydraulic fluid into the lift chamber 75 defined in the cylinder 60 beneath the piston 62. As a result, the piston 62 raises in the cylinder 60 to lift the intermediate frame 18. Once the desired height is reached, as indicated by the user interface (e.g., user stops pressing button to raise intermediate frame 18), the valve 70 is closed. In some embodiments, the valve 70 is a one-way poppet valve that opens when the lift pump 68 operates and automatically closes once the lift pump 68 stops.

When the user interface indicates that the intermediate frame 18 is to be lowered, the valve 70 is kept closed and the valve 72 is opened by the controller 36. The valve 72 may be a solenoid valve or any suitable hydraulic valve that allows for the flow of fluid. Hydraulic fluid is then allowed to flow back into the reservoir 74 under the pressure created by the weight of the intermediate frame 18 and the patient P on the patient support surface 14.

In the embodiment of FIG. 3, the suspension system 28 is integrated into the lift system 57 by virtue of a hydraulic accumulator 76. A control valve 78 provides selective communication between the cylinder 60 and the hydraulic accumulator 76. The control valve 78 is a solenoid valve having a variable orifice 80. When the valves 70, 72 and the control valve 78 are closed, the hydraulic fluid in the cylinder 60, which is an incompressible fluid, maintains the height of intermediate frame 18 above the base frame 16 in a relatively rigid manner. This configuration of the valves 70, 72 and the control valve 78 represents the lockout mode. Opening of the control valve 78 allows the hydraulic fluid to pass from the cylinder 60 to the hydraulic accumulator 76. This configuration of the control valve 78 represents the energy-absorbing mode.

The controller 36 is in communication with the control valve 78 to control opening and closing of the variable orifice 80 thereby controlling fluid movement between the hydraulic unit 58 and the hydraulic accumulator 76. As described above, in one embodiment, the controller 36 simply opens the control valve 78 to place the suspension system 28 in the energy-absorbing mode and closes the control valve 78 to place the suspension system 28 in the lockout mode. In other embodiments, the control valve 78 controls the variable orifice 80 to be open in the lockout mode, yet have a cross-sectional area in the lockout mode that is less than in the energy-absorbing mode. Adjustment of the variable orifice 80 of the control valve 78 also operates to change the damping effect of the suspension system 28. Control of the control valve 78 can be responsive to any of the sensing methods described herein. Additionally, the control valve 78 could be controlled mechanically in response to manual actuation of the CPR selector 43, brake pedal 55, or other manual control.

The hydraulic accumulator 76 comprises a cylinder 82 and a piston 84 slidable in the cylinder 82. The cylinder 82 comprises a front chamber 86 in selective communication with the lift chamber 75 via the control valve 78. The cylinder 82 also comprises a rear chamber 88 having a volume of pressurized air. This volume of pressurized air acts as the spring 30 in this version of the suspension system 28. In other versions, a variable rate mechanical spring could be employed in the rear chamber 88.

When the wheels 20 encounter disturbances in the floor surfaces, the wheels 20 accelerate toward the patient support surface 14 thereby accelerating the cylinder 60 upwardly toward the patient support surface 14. If the control valve 78 is closed, then the hydraulic unit 58 is relatively rigid and unable to absorb much energy thereby transmitting undesired forces to the patient support surface 14 and potentially causing discomfort to the patient P. However, if the control valve 78 is open, when the cylinder 60 accelerates upwardly, the piston 62 and patient support surface 14 accelerate at a lower rate by virtue of fluid in the lift chamber 75 being expressed out of the lift chamber 75 and into the front chamber 86 via the variable orifice 80 under the weight of the patient P and the intermediate frame 18.

A pair of accumulator solenoid valves 87, 89 controls movement of air into and out of the rear chamber 88 to adjust the spring rate (k) of the spring 30. A spring pump 90 operates to pump air into the rear chamber 88 when the accumulator solenoid valve 87 is open and the accumulator solenoid valve 89 is closed. A spring pump motor 91 runs the spring pump 90. When opened, the accumulator solenoid valve 89 allows air in the rear chamber 88 to escape to atmosphere A thereby lowering the air pressure in the rear chamber 88 and hence the spring rate (k) of the spring 30. The accumulator solenoid valves 87, 89 and motor 67 are in communication with the controller 36 to be controlled by the controller 36.

A pressure sensor 92 is present in the rear chamber 88. The pressure sensor 92 is in communication with the controller 36 to monitor and control pressure in the rear chamber 88.

A potentiometer 93 or other suitable device is in communication with the controller 36 to determine the distance that the piston 84 travels when loaded, i.e., with the patient P in position on the patient support surface 14. In some embodiments, the pressure in the rear chamber 88 is controlled by the controller 36 so that the piston 84 travels forty percent or less of its total travel when loaded so that the piston 84 has room for additional travel when the patient transport apparatus 10 encounters the disturbances in the floor surfaces. The travel distance of the piston 84 could also be dependent on patient weight and established by a lookup table of travel distances based on patient weight, as detected by the load sensing system 48.

The lift system 57 is operable to raise and lower the patient support surface 14 relative to the wheels 20 between a maximum height and a minimum height. The controller 36 is in communication with the lift system 57 to automatically raise the patient support surface 14 at least a predetermined distance (d) above the minimum height in the energy-absorbing mode to provide at least a minimum amount of travel in the energy-absorbing mode. For instance, with respect to FIG. 3, the intermediate frame 18 is shown spaced above the minimum height by the predetermined distance (d). However, if the intermediate frame 18 was already abutting a top of the cylinder 60 at the minimum height, then the piston 62 could not travel relative to the cylinder 60 to provide any suspension and forces transferred to the cylinder 60 from encountered disturbances in the floor surfaces would be directly transferred to the intermediate frame 18 and the patient P.

The predetermined distance (d) may be greater than zero inches, from about zero inches to about ten inches, from about one inch to about ten inches, from about two inches to about ten inches, from about three inches to about ten inches, or from about three inches to about five inches.

The above-described integration of the suspension system 28 into the lift system 57 could also be employed in other types of hydraulic lift systems, such as lift systems that employ hydraulic actuators to raise and lower mechanical lift members.

In the energy-absorbing mode, a suspension property, such as the spring rate (k), damping effect, and/or travel can be adjusted to change a ride setting of the suspension system 28. In one embodiment, the suspension system 28 is configured to operate in at least two different ride settings in the energy-absorbing mode. Each ride setting is associated with a different set of properties of the suspension system 28 that reduces disturbances to the patient P during transport to provide a comfortable ride to the patient.

The controller 36 controls the suspension system 28 to switch between the different ride settings, e.g., different spring 30 and/or damper 32 settings. In particular, the controller 36 transmits a ride setting control signal to the suspension system 28 to set the suspension system 28 to the desired ride setting. In one embodiment, this ride setting control signal is based, in part, on an output generated by load sensing system 48, such as the load cells 49 configured to detect the weight of the patient P on the patient support surface 14.

As previously described, the load sensing system 48 enables the controller 36 to determine the weight of the patient P. In some embodiments, the desired ride setting is set based on the weight of the patient P. A lookup table stored in the memory 40 comprises weight ranges and associated ride settings. The controller 36 accesses the lookup table once the weight of the patient P is calculated and then transmits the ride setting control signal to the suspension system 28 to set the suspension system 28 to the corresponding ride setting from the lookup table. In other words, the controller 36 is able to tune the suspension system 28 based on the weight of the patient P. In some cases, with relatively lighter patients, the lookup table comprises lower values of the spring rate (k) and damping effect and, for heavier patients, the lookup table comprises higher values of the spring rate (k) and damping effect.

In other embodiments, the controller 36 sums the weight of the patient P and the components of the patient transport apparatus 10 that are being supported by the suspension system 28 to determine a sprung weight. The sprung weight is the load being supported by the suspension system 28 during operation of the patient transport apparatus 10. In some embodiments, the desired ride setting is set based on the sprung weight. A lookup table stored in the memory 40 comprises sprung weight ranges and associated ride settings. The controller 36 accesses the lookup table once the sprung weight is calculated and then transmits the ride setting control signal to the suspension system 28 to set the suspension system 28 to the corresponding ride setting from the lookup table.

In configurations where the patient transport apparatus 10 comprises the load sensing system 48, the load cells 49 also enable the controller 36 to determine the location of the center of mass of the patient P on the patient support surface 14. This is useful when the suspension system 28 comprises multiple suspension devices, e.g., multiple springs 30 and dampers 32, positioned at different locations on the patient transport apparatus 10. The suspension parameters of each suspension device may be independently adjusted. For example, one spring 30 and damper 32 arrangement may be positioned adjacent to each of the four corners of the patient transport apparatus 10 to correspond to each of the load cells 49. Accordingly, each of the spring 30 and damper 32 arrangements can be independently controlled by the controller 36 to different ride settings based on the location of the center of mass of the patient P on the patient support surface 14. For instance, the spring 30 and damper 32 arrangement nearest the location of the center of mass of the patient P can be set to a different stiffness than the remaining spring 30 and damper 32 arrangements.

In some cases, it is desirable to keep the patient support surface 14 level during accelerations and decelerations of the patent transport apparatus 10, e.g., during cornering and when starting and stopping movement of the patient transport apparatus 10. Such accelerations can be detected using accelerometers (not shown) communicating with the controller 36. The accelerometers may be located on the support structure 12 or at other suitable locations. Each of the spring 30 and damper 32 arrangements can be independently controlled by the controller 36 to different ride settings based on the detected accelerations to keep the patient support surface 14 level. These adjustments of the spring 30 and damper 32 arrangements can also take into account the location of the center of mass of the patient P. For instance, when cornering acceleration has been detected (such as by a lateral accelerometer), the spring 30 and damper 32 arrangements nearest the location of the center of mass of the patient P may be set to a stiffer ride setting to compensate for the cornering acceleration and to keep the patient support surface 14 level during the cornering acceleration.

The controller 36 may also determine a ride setting for the suspension system 28 based on the signal from the surface sensor 50. In one embodiment, a first ride setting corresponds to a first stiffness and a second ride setting corresponds to a second stiffness. The first stiffness is greater than the second stiffness. These variations in stiffness are useful when different floor surfaces are detected. For instance, if the floor surface is similar to a gravel road, then the second stiffness may be preferred. If the floor surface is relatively smooth, then the first stiffness may be preferred. It should be understood that the number of ride settings is not particularly limited, and as such, two, three, four, five, or more ride settings are contemplated, each having different properties.

In other embodiments, the controller 36 may determine a ride setting for the suspension system 28 based on a signal from one or more of the other sensors shown in FIG. 2, including, for example, the motion sensor 46. The motion sensor 46 may detect accelerations and decelerations of the patient transport apparatus 10 and the controller 36 may adjust the suspension system 28 accordingly to account for such movement.

In certain configurations, the patient transport apparatus 10 may comprise a ride selection interface. The ride selection interface 94 (see illustration in FIG. 2) is in communication with the controller 36 to enable selection of a desired ride setting by the operator O, other caregiver, or the patient P. The ride selection interface 94 is accessible via a touch screen display 96 on the patient transport apparatus 10. The touch screen display 96 is optionally mounted to the operator interface 26 or the intermediate frame 18. In cases where the patient transport apparatus 10 is a hospital bed, the touch screen display 96 may be integrated into the footboard, headboard, and/or one or more of the side rails. The ride selection interface 94 may also take the form of mechanical push buttons, knobs, sliders, and the like. In other versions, the ride selection interface 94 could be voice-activated or otherwise remotely activated.

The operator O, for example, is presented with touch-selectable buttons 95A, 95B, 95C on the touch screen display 96 that correspond to each of the different ride settings. Once one of the touch-selectable buttons 95A, 95B, 95C is actuated, a signal is sent to the controller 36 corresponding to the selected ride setting and the controller 36 transmits a corresponding control signal to the suspension system 28 to set the ride setting to the selected ride setting. Alternatively, a pair of touch-selectable arrow-shaped buttons for increasing or decreasing the ride setting may be presented to the operator O to change the ride setting.

Figure 4:
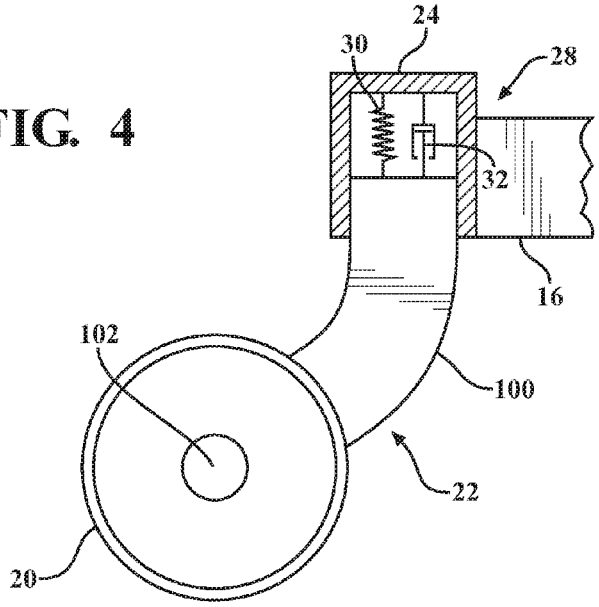
FIG. 4 is an illustration of another embodiment of the suspension system for the patient transport apparatus.

Many alternative locations for the suspension system 28 on the patient transport apparatus 10 are contemplated. In one embodiment, referring to FIG. 4, the suspension system 28 comprises a spring 30 and damper 32 disposed between each of the hubs 24 and the casters 22. This yields four sets of springs 30 and dampers 32 on the patient transport apparatus 10.

Each of the casters 22 comprises a caster arm 100 having a first end and a second end. The hub 24 supports the first end of the caster arm 100 so that the caster arm 100 is able to swivel relative to the base frame 16. A spring 30 and damper 32 are disposed between the first end of the caster arm 100 and the hub 24. The wheels 20 are coupled to the caster arm 100 at shaft 102 near the second end of the caster arm 100. The wheels 20 rotate about the shaft 102.

Figure 5A:
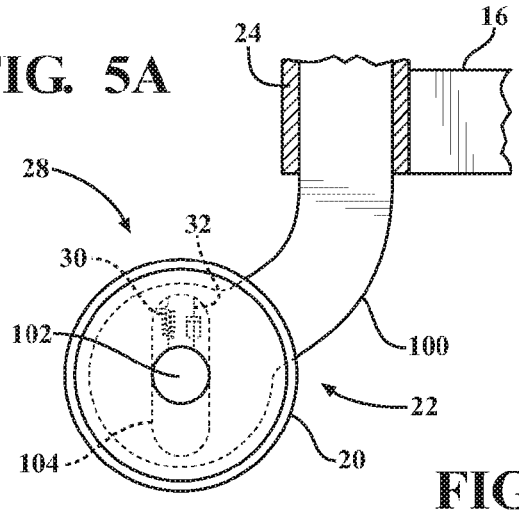
FIGS. 5A and 5B are illustrations of another embodiment of the suspension system for the patient transport apparatus.
Figure 5B:
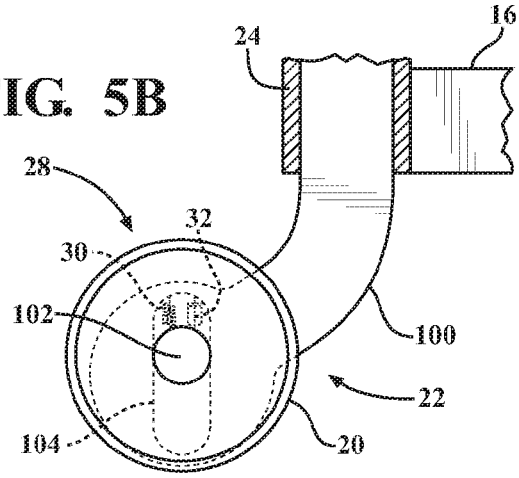

In another embodiment, referring to FIGS. 5A and 5B, the suspension system 28 comprises a spring 30 and damper 32 integrated into each of the casters 22. In this embodiment, each of the caster arms 100 comprises a slot 104. The shaft 102, about which the wheel 20 rotates, rides in the slot 104. The spring 30 and damper 32 are arranged between the shaft 102 and the caster arm 100 in the slot 104.

During transport, when the wheel 20 encounters a disturbance, such as a bump, the wheel 20 accelerates vertically toward the patient support surface 14. Likewise, the shaft 102, which is connected to the wheel 20 (or pairs of wheels in cases of dual-wheeled casters), also accelerates vertically with the wheel 102. In cases where the wheels 20 are formed of resilient materials, some impact forces are absorbed by the wheel 20 while the remaining forces translate into acceleration of the wheel 20 and shaft 102 toward the patient support surface 14. The spring 30 and damper 32 interrupt further transfer of the forces toward the patient supporting surface 14 by acting between the shaft 102 and the caster arm 100.

By integrating the suspension system 28 into the casters 22, the sprung weight is maximized. Accordingly, in typical conditions, changes in patient weights may have relatively little effect on the performance of the suspension system 28 since the patient weight is only a small component of the overall sprung weight. This may be beneficial in certain embodiments where the suspension system 28 is unable to be adjusted to different patient weights.

Figure 6:
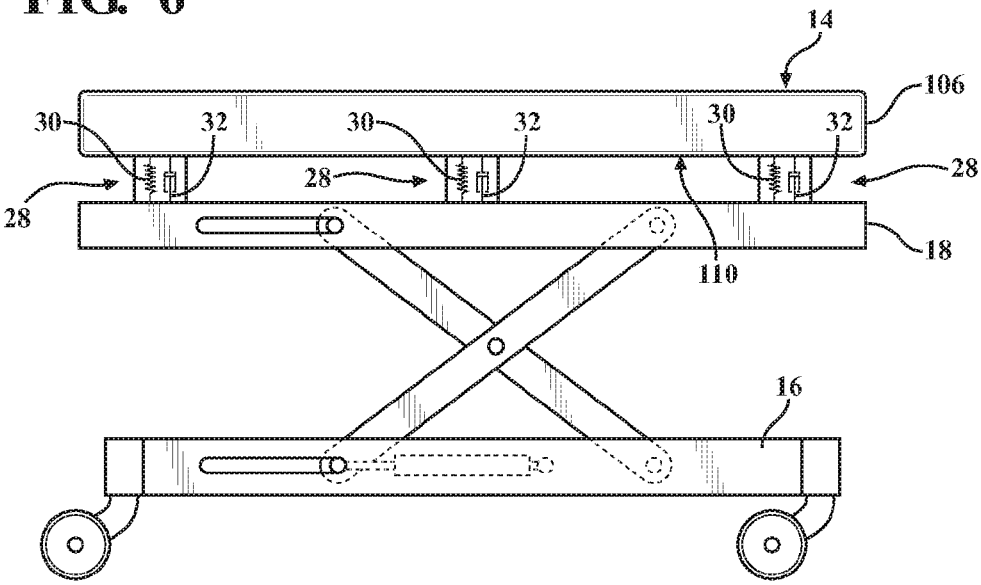
FIG. 6 is an illustration of another embodiment of the suspension system for the patient transport apparatus.

Referring to FIG. 6, in another embodiment, the suspension system 28 comprises three sets of springs 30 and dampers 32 located between the intermediate frame 18 and mattress 106. The mattress 106 comprises an upper surface that defines the patient support surface 14 for the patient P. The mattress 106 also comprises a lower surface 110, relatively more rigid than the upper surface. The three sets of springs 30 and dampers 32 are located between the intermediate frame 18 and the lower surface 110 of the mattress 106. By placing the suspension system 28 between the mattress 106 and the intermediate frame 18, the suspension system 28 is very sensitive to variations in patient weight. This may be beneficial in some embodiments such as those in which the controller 36 is able to tune the suspension system 28 based on patient weight.

The suspension system 28 may also be attached directly to the base frame 16, such as by employing a separate suspension frame (not shown) that is suspended above the base frame 16 by several spring 30 and damper 32 arrangements. For instance, the suspension frame may be rectangular and have four spring 30 and damper 32 arrangements at each corner connecting the suspension frame to the base frame 16. The lift system would then interconnect the suspension frame and the intermediate frame 18 such that the suspension frame bears all the weight of the patient transport apparatus 10 arranged above the base frame 16.

The suspension system 28 could also be integrated into transverse and/or longitudinal tubes of the base frame 16 between the casters 22.

Figure 7:
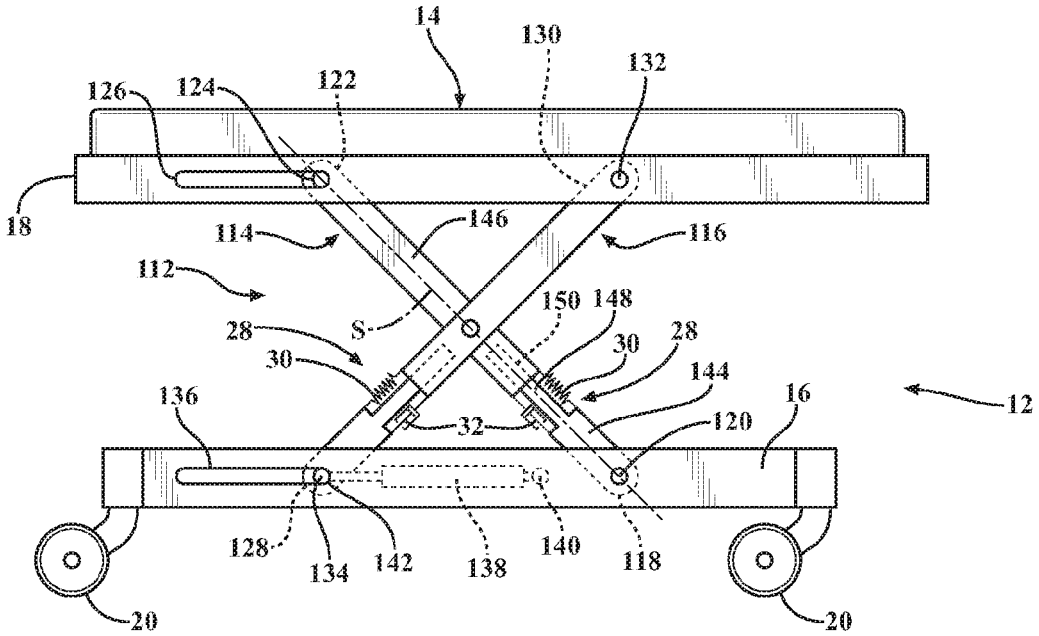
FIG. 7 is an illustration of another embodiment of the suspension system for the patient transport apparatus.

Referring to FIG. 7, in another embodiment, the suspension system 28 comprises two sets of springs 30 and dampers 32, integral with a scissor type lift system 112. The scissor type lift system 112 comprises a first lift arm 114 and a second lift arm 116. The lift arms 114, 116 form part of the support structure 12. The lift arms 114, 116 are movable to raise and lower the patient support surface 14 relative to the wheels 20. The first lift arm 114 has a first end 118 pivotally connected to the base frame 16 at a fixed pivot point 120. The first lift arm 114 extends from the first end 118 to a second end 122. A pin 124 is fixed to the second end 122 and arranged to slide in a horizontal guide slot 126 defined in the intermediate frame 18.

The second lift arm 116 has a first end 128 and a second end 130. The second end 130 is pivotally connected to the intermediate frame 18 at a fixed pivot point 132. A pin 134 is fixed to the first end 128 and arranged to slide in a horizontal guide slot 136. A linear actuator 138 has a first actuator end 140 fixed to the base frame 16 and a second actuator end 142 fixed to the pin 134. When actuated, the linear actuator 138 directly slides the pin 134 in the horizontal guide slot 136, which also indirectly slides the pin 124 in the horizontal guide slot 126, to raise and lower the patient support surface 14.

The two sets of springs 30 and dampers 32 are integral with the lift arms 114, 116. The first lift arm 114 is formed of first and second sections 144, 146. The first section 144 has a male part 148 and the second section 146 comprises a female receiver 150 to form a telescoping connection. The telescoping connection allows the first section 144 to slide within the second section 146. The first section 144 and second section 146 are constrained from relative movement other than relative linear movement along a common slide axis S. The spring 30 and damper 32 are located between the first and second sections 144, 146 to provide suspension. The spring 30 and damper 32 also prevent the first and second sections 144, 146 from becoming disconnected. The spring 30 and damper 32 are configured so that the first and second sections 144, 146 have sufficient relative travel along the slide axis S in the energy-absorbing mode to provide suspension. The other spring 30 and damper 32 are integrated into the second lift arm 116 in the identical manner as the first lift arm 114.

In other embodiments, the suspension system 28 may be integrated into the linear actuator 138. The suspension system 28 may also be integrated into other types of lift systems such as lift systems that comprise hydraulic actuators, electrical actuators, pneumatic actuators, or any other suitable device for raising and lowering the patient support surface 14. These alternative lift system configurations may comprise one or more integrated suspension devices. For instance, one or more actuators of these lift systems could include one or more suspension devices.

Figure 8:
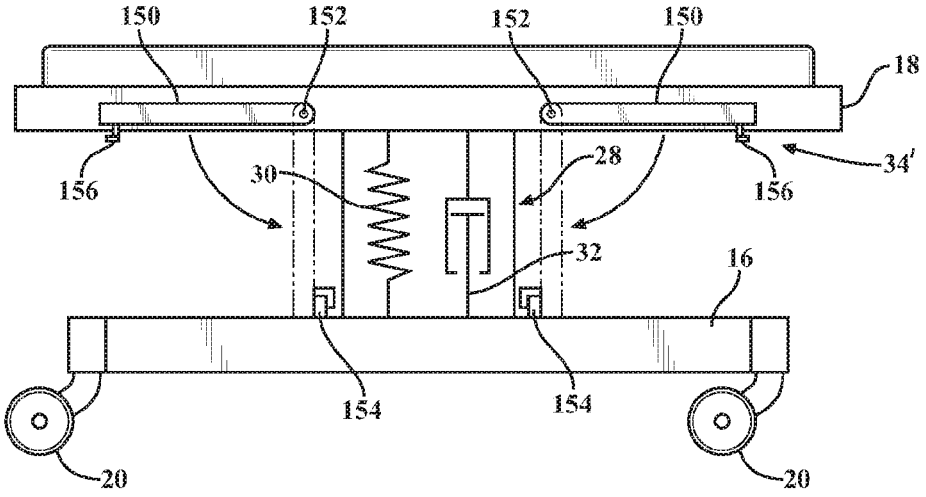
FIG. 8 is an illustration of another embodiment of the suspension system for the patient transport apparatus.

Referring to FIG. 8, in one embodiment, an alternative control system 34' is shown that comprises four control devices 150 (two shown on one side and two on opposite side not shown). The control devices 150 shown in FIG. 8 are pivot arms pivotally connected to the intermediate frame 18 at fixed pivot points 152. The control devices 150 pivot between stowed positions shown in solid lines in FIG. 8 and lockout positions shown in hidden lines in FIG. 8.

In the stowed positions, the suspension system 28 operates in the energy-absorbing mode to absorb energy that might otherwise be transferred to the patient support surface 14 when the wheels 20 encounter disturbances in the floor surfaces. In this case, the spring 30 may be a coil spring having a single preset spring rate (k). The damper 32 may be a shock absorber having a single preset damping effect (e.g., fixed orifice area). In other words, the spring 30 and damper 32 may be adjustable or not.

When it is desired to place the suspension system 28 in the lockout mode, the control devices 150 are pivoted about the fixed pivot points 152 toward the base frame 16 to engage bump stops 154 on the base frame 16. Detent fingers 156 on the control devices 150 latch over the bump stops 154 to hold the control devices 150 in the lockout position. In this position, the control devices 150 provide four rigid connections between the intermediate frame 18 and the base frame 16, essentially bypassing the suspension system 28 so that the patient transport apparatus 10 is relatively rigid compared to the energy-absorbing mode. A variety of control devices are contemplated, so long as the control device can be configured to provide a selectively rigid connection between the intermediate frame 18 and the base frame 16.

The control devices 150 may be manually manipulated by the operator O to place the suspension system 28 in the lockout mode. In other embodiments, motors (not shown) may be connected to the control devices 150 to pivot the control devices 150 under instruction of the controller 36. In this embodiment, the motors are in communication with the controller 36 so that when the controller 36 operates to switch the suspension system 28 to the lockout mode, the controller 36 sends output signals to each of the motors to move the control devices 150 to the lockout positions.

Figure 9:
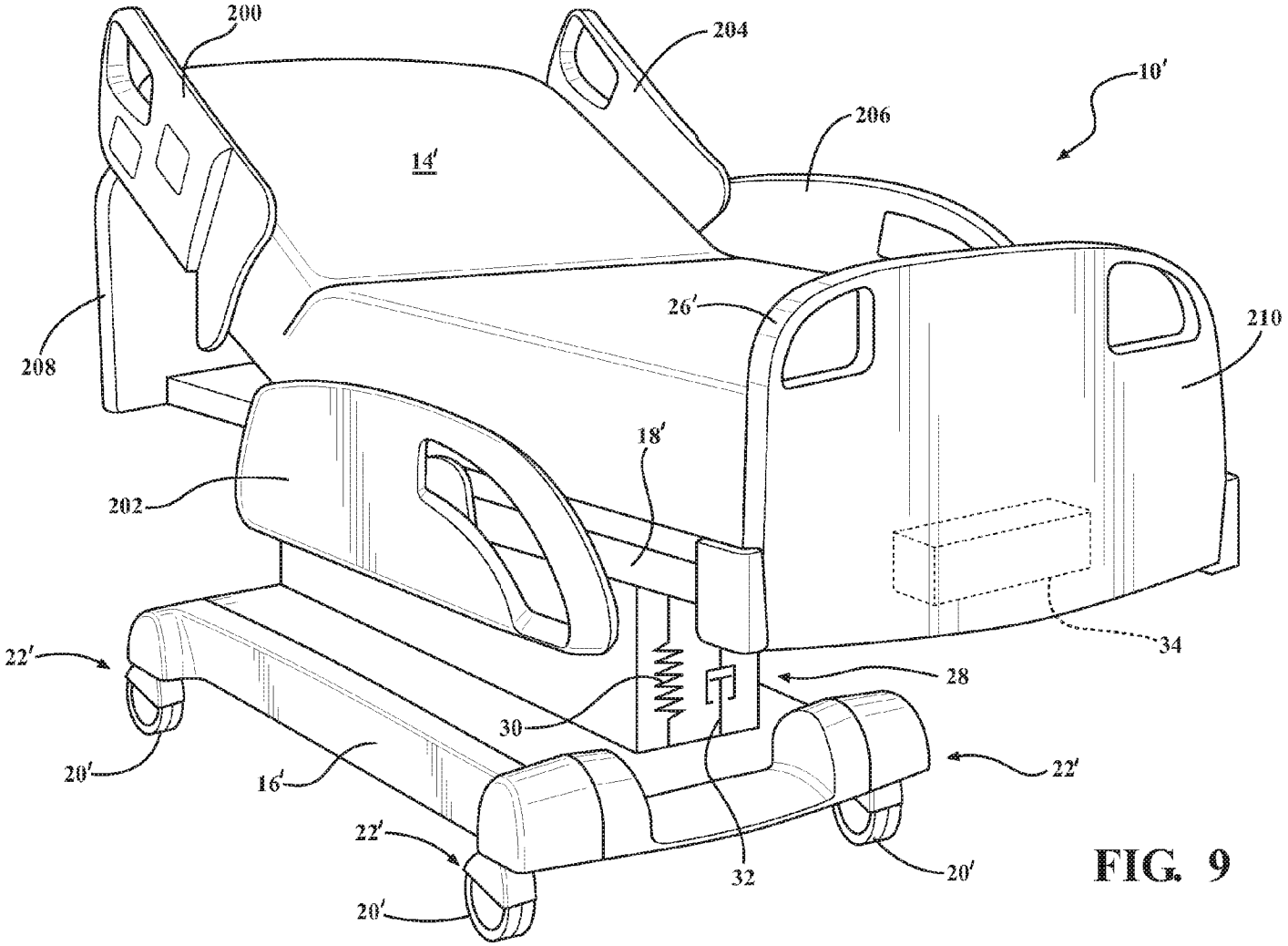
FIG. 9 is a perspective and partially schematic view of an alternative patient transport apparatus.

In an alternative patient transport apparatus 10' shown in FIG. 9, side rails 200, 202, 204, 206 are coupled to the intermediate frame 18'. Like numerals (demarcated by an apostrophe) in FIG. 9 refer to like parts of the previously described embodiments. The first side rail 200 is positioned at a right head end of the intermediate frame 18'. The second side rail 202 is positioned at a right foot end of the intermediate frame 18'. The third side rail 204 is positioned at a left head end of the intermediate frame 18'. The fourth side rail 206 is positioned at a left foot end of the intermediate frame 18'. If the patient transport apparatus 10 is a stretcher or a cot, there may be fewer side rails. The side rails 200, 202, 204, 206 are movable between a raised position in which they block ingress and egress into and out of the patient transport apparatus 10', and a lowered position in which they are not an obstacle to such ingress and egress.

Patient transport apparatus 10' also comprises a headboard 208 and a footboard 210. In this embodiment, the operator interface 26' is a handle integrated into the footboard 210. In other embodiments, the handle may be integrated into the headboard 208 or may be positioned on or adjacent the footboard 210 and/or on or adjacent the headboard 208.

Although a simple schematic illustration of the suspension system 28 comprising a spring 30 and damper 32 is shown in FIG. 9, any of the various embodiments of the suspension system 28 and control system 34 described herein can likewise be utilized on the patient transport apparatus 10' shown in FIG. 9.

The term "memory" is intended to comprise memory associated with a processor such as a CPU, and may include, for example, RAM (random access memory), ROM (read only memory), a fixed memory device (for example, hard drive), a removable memory device (for example, diskette), a flash memory and the like.

As will be appreciated by one skilled in the art, the embodiments described herein may include a computer program product embodied in one or more computer readable medium(s) having computer readable program code embodied thereon. Computer software including instructions or code for performing the methods described herein, may be stored in one or more of the associated memory devices (for example, ROM, fixed or removable memory) and, when ready to be utilized, is loaded in part or in whole (for example, into RAM) and implemented by a CPU. Such software could include, but is not limited to, firmware, resident software, microcode, and the like.

It will be further appreciated that the terms "include," "includes," and "including" have the same meaning as the terms "comprise," "comprises," and "comprising."

Several embodiments have been discussed in the foregoing description. However, the embodiments discussed herein are not intended to be exhaustive. The terminology which has been used is intended to be in the nature of words of description rather than of limitation. Many modifications and variations are possible in light of the above teachings.

What is claimed is:

1. A patient transport apparatus for transporting a patient over disturbances in floor surfaces, said transport apparatus comprising:

a support structure comprising a patient support surface to support the patient;

wheels coupled to said support structure;

an operator interface coupled to said support structure to enable an operator to transport the patient over the floor surfaces;

a suspension system operable in a first mode and a second mode, said suspension system being configured in at least one of said modes to absorb energy as said wheels move over the disturbances in the floor surfaces during transport to limit energy transfer to said patient support surface thereby limiting discomfort to the patient; and a control system to place said suspension system in one of said modes, wherein said first mode is an energy-absorbing mode in which said suspension system absorbs energy as said wheels move over the disturbances in the floor surfaces during transport and said second mode is a lockout mode in which said suspension system is relatively more rigid as compared to said energy-absorbing mode, and wherein said control system comprises a status input to determine at least one of an operational state of said transport apparatus or a patient state and a controller to place said suspension system in said energy-absorbing mode or said lockout mode based on said at least one of said operational state or said patient state.

2. The transport apparatus of claim 1 wherein said status input is a motion sensor in communication with said controller to determine whether said transport apparatus is in motion or is stationary, said controller configured to place said suspension system in said lockout mode when said transport apparatus is stationary and to place said suspension system in said energy-absorbing mode when said transport apparatus is in motion.

3. The transport apparatus of claim 1 wherein said status input comprises at least one load cell in communication with said controller to determine if the patient is positioned for ingress or egress relative to said patient support surface, said controller configured to place said suspension system in said lockout mode when the patient is positioned for ingress or egress relative to said patient support surface.

4. The transport apparatus of claim 1 wherein said status input comprises a CPR sensor in communication with said controller to determine if said transport apparatus is in a CPR mode, said controller configured to place said suspension system in said lockout mode when said CPR sensor detects said CPR mode.

5. A patient transport apparatus for transporting a patient over disturbances in floor surfaces, said transport apparatus comprising:

a support structure comprising a patient support surface to support the patient;

wheels coupled to said support structure;

an operator interface coupled to said support structure to enable an operator to transport the patient over the floor surfaces;

a suspension system operable in a first mode and a second mode, said suspension system being configured in at least one of said modes to absorb energy as said wheels move over the disturbances in the floor surfaces during transport to limit energy transfer to said patient support surface thereby limiting discomfort to the patient; and a control system to place said suspension system in one of said modes, wherein said first mode is an energy-absorbing mode in which said suspension system absorbs energy as said wheels move over the disturbances in the floor surfaces during transport and said second mode is a lockout mode in which said suspension system is relatively more rigid as compared to said energy-absorbing mode, and wherein said suspension system is selectively operable at a first ride setting or a second ride setting in said energy-absorbing mode, said first ride setting being different than said second ride setting.

6. The transport apparatus of claim 5 wherein said control system comprises at least one load cell to generate output associated with a load of the patient on said patient support surface and a controller in communication with said at least one load cell to receive said output and transmit a control signal to said suspension system to switch said suspension system from said first ride setting to said second ride setting based on said output.

7. The transport apparatus of claim 6 wherein said controller is configured to process said output to determine a sprung weight supported by said suspension system, said sprung weight comprising a weight of the patient.

8. The transport apparatus of claim 6 wherein said suspension system comprises suspension devices, said suspension system configured to independently adjust said suspension devices based on said output.

9. The transport apparatus of claim 6 wherein said suspension system comprises a spring having an adjustable spring parameter.

10. The transport apparatus of claim 9 wherein said suspension system comprises a damper having an adjustable damping parameter, said suspension system configured to adjust at least one of said adjustable spring parameter or said adjustable damping parameter in response to receiving said control signal from said controller.

11. The transport apparatus of claim 10 wherein said controller comprises memory to store spring and damper settings corresponding to said output and said suspension system is configured to adjust said at least one of said adjustable spring parameter or said adjustable damping parameter based on said spring and damper settings.

12. The transport apparatus of claim 5 wherein said control system comprises a surface sensor to detect the disturbances in the floor surfaces and generate corresponding output and a controller in communication with said surface sensor to receive said output and transmit a control signal to said suspension system to switch said suspension system from said first ride setting to said second ride setting based on said output.

13. The transport apparatus of claim 5 wherein said control system comprises a controller and a ride selection interface in communication with said controller to enable selection of said first ride setting or said second ride setting, said controller configured to switch said suspension system to said first ride setting or said second ride setting based on said selection.

14. The transport apparatus of claim 5 wherein said control system comprises a manual control device configured to be manually manipulated by the operator to place said suspension system in one of said modes.

15. The transport apparatus of claim 5 wherein said operator interface comprises a handle coupled to said support structure.

16. The transport apparatus of claim 5 wherein said suspension system comprises a suspension device.

17. A patient transport apparatus for transporting a patient over disturbances in floor surfaces, said transport apparatus comprising:

a support structure comprising a patient support surface to support the patient;

wheels coupled to said support structure;

an operator interface coupled to said support structure to enable an operator to transport the patient over the floor surfaces;

a suspension system operable in a first mode and a second mode said, suspension system being configured in at least one of said modes to absorb energy as said wheels move over the disturbances in the floor surfaces during transport to limit energy transfer to said patient support surface thereby limiting discomfort to the patient, said suspension system comprising a suspension device; and a control system to place said suspension system in one of said modes, wherein said support structure comprises a frame, said suspension device disposed between said patient support surface and said frame.

18. A patient transport apparatus for transporting a patient over disturbances in floor surfaces, said transport apparatus comprising:

a support structure comprising a patient support surface to support the patient;

wheels coupled to said support structure;

an operator interface coupled to said support structure to enable an operator to transport the patient over the floor surfaces;

a suspension system operable in a first mode and a second mode, said suspension system being configured in at least one of said modes to absorb energy as said wheels move over the disturbances in the floor surfaces during transport to limit energy transfer to said patient support surface thereby limiting discomfort to the patient, said suspension system comprising a suspension device; and a control system to place said suspension system in one of said modes, wherein said support structure comprises a base frame fixed to said wheels and an intermediate frame spaced from said base frame, said suspension device disposed between said intermediate frame and said base frame.

19. The transport apparatus of claim 16 further comprising a caster arm coupled to one of said wheels to form a caster, said caster arm further comprising a slot and a shaft riding within said slot, said one of said wheels rotating about said shaft, with said suspension device being arranged between said shaft and said caster arm in said slot.

20. The transport apparatus of claim 5 wherein said suspension system has a first stiffness in said energy-absorbing mode and a second stiffness greater than said first stiffness in said lockout mode so that said suspension system is relatively more rigid in said lockout mode as compared to said energy-absorbing mode.

21. The transport apparatus of claim 5 wherein:

said support structure comprises a hydraulic unit coupled to said patient support surface to raise and lower said patient support surface with respect to said wheels;

said suspension system comprises a hydraulic accumulator;

said control system comprises a controller and a control valve having a variable orifice; and said controller is in communication with said control valve to control opening and closing of said variable orifice thereby controlling fluid movement between said hydraulic unit and said hydraulic accumulator, wherein said variable orifice has a first cross-sectional area in said energy-absorbing mode and a second cross-sectional area in said lockout mode, said first cross-sectional area being greater than said second cross-sectional area.

22. The transport apparatus of claim 21 wherein said suspension system further comprises a pump in operative communication with said hydraulic accumulator to adjust a pressure in said hydraulic accumulator in said energy-absorbing mode.

* * * * *